US007438212B2

(12) United States Patent
Barthel et al.

(10) Patent No.: US 7,438,212 B2
(45) Date of Patent: Oct. 21, 2008

(54) CONTAINER

(75) Inventors: Wolfgang Barthel, Langenfeld (DE); Salvatore Fileccia, Oberhausen (DE); Ulf Arno Timmann, Köln (DE); Rudolf Töpler, Köln (DE); Thomas Binder, Wildpoldsried (DE)

(73) Assignee: Henkel Kommanditgesellschaft auf Aktien, Düsseldorf (DE)

( * ) Notice: Subject to any disclaimer, the term of this patent is extended or adjusted under 35 U.S.C. 154(b) by 0 days.

(21) Appl. No.: 11/675,988

(22) Filed: Feb. 16, 2007

(65) Prior Publication Data

US 2007/0181657 A1 Aug. 9, 2007

Related U.S. Application Data

(63) Continuation of application No. PCT/EP2006/000083, filed on Jan. 7, 2006.

(60) Provisional application No. 60/817,625, filed on Jun. 29, 2006.

(30) Foreign Application Priority Data

Mar. 1, 2005 (DE) ..... 10 2005 009 908
Nov. 21, 2005 (DE) ..... 10 2005 055 814

(51) Int. Cl.
*B65D 5/74* (2006.01)

(52) U.S. Cl. ..... 229/215; 229/940

(58) Field of Classification Search ..... 229/215, 229/221, 940; 222/541.5, 541.6, 572
See application file for complete search history.

(56) References Cited

U.S. PATENT DOCUMENTS 2,338,260 A * 1/1944 Ringler ..... 229/215
2,509,289 A * 5/1950 Dunning ..... 229/215
2,818,207 A * 12/1957 Wilson ..... 229/215
2,842,302 A * 7/1958 Ryder ..... 229/215
3,131,847 A 5/1964 Desmond
3,226,003 A 12/1965 Hickin
3,262,627 A 7/1966 Kersh et al.

(Continued)

FOREIGN PATENT DOCUMENTS

DE 7230742 1/1973

(Continued)

*Primary Examiner*—Gary E Elkins
(74) *Attorney, Agent, or Firm*—Paul & Paul

(57) ABSTRACT

A container, in particular for free-flowing substances, comprising a blank (16) made of sheet-like, flexible material in particular cardboard, which can be folded at least to form part of the container, a first wall (1) and a second, adjacent wall (4) of the container, the walls (1, 4) being angled in relation to one another and being connected integrally to one another in the region of a common edge (5), it being the case that a weakening line (7) runs over each of the walls (1, 4) and surrounds the region of a reclosable pouring element (6), which is formed essentially from the material of the walls (1, 4), and that a line of inflection (15) passes through the pouring element (6), crossing over the edge (5) in the process, and divides the pouring element (6) into a pouring portion (6*a*) and an operating portion (6*b*). A container in which a greater number of opening and closing actions is made possible is provided in that the operating portion (6*b*) has a reinforcing element (9) in the region of the edge (5).

15 Claims, 3 Drawing Sheets

U.S. PATENT DOCUMENTS 3,404,828 A 10/1968 Whipperman
3,692,227 A 9/1972 Hennessey et al.
3,981,430 A * 9/1976 Keim ..... 229/215
4,356,951 A * 11/1982 Sharp ..... 229/125.42
4,684,058 A * 8/1987 Weber ..... 229/940
5,494,216 A * 2/1996 Van Suntenmaartensdijk ... 229/215
6,394,339 B1 * 5/2002 Giblin ..... 229/125.14

FOREIGN PATENT DOCUMENTS

DE 8530780 1/1986
WO WO99/35038 7/1999

* cited by examiner

CONTAINER

CROSS-REFERENCE TO RELATED APPLICATIONS

This application is a continuation of international application PCT/EP/2006/000083 filed Jan. 7, 2006 from which priority is claimed under 35 U.S.C. §365(c), which, in turn, is based on the following German applications from which priority is claimed 10 2005 009 908.4 filed Mar. 1, 2005 and 10 2005 055 814.3 filed Nov. 21, 2005. This application claims the benefit of U.S. provisional application 60/817,625 filed Jun. 29, 2006.

The present invention relates to a container, in particular for free-flowing substances.

BACKGROUND OF THE INVENTION

The prior art discloses a large number of containers by means of which, in particular, free-flowing substances, for example salt, can be stored, transported and dispensed in measured quantities. For the purpose of dispensing contents from the container, a number of solutions in which a measuring-out spout can be pulled out of the container are known. Such solutions are disclosed in U.S. Pat. No. 3,692,227, U.S. Pat. No. 3,404,828 or U.S. Pat. No. 3,313,847.

For example, U.S. Pat. No. 3,692,227 discloses a carton in which a pouring element is defined by a weakening line in the region of one edge of the carton, it being possible to use finger pressure to press in a bottom portion of the pouring element, whereupon a top part of the pouring element swings outward. The top part can then be swung in again, whereupon a closed state of the pouring element is reinstated.

Such known solutions are disadvantageous in practice because only a small number of repeatable opening actions of the pouring element is possible before this mechanism ceases to function as a result of wear to the carton.

This is relevant since the active-substance concentrations in the free-flowing substances, for example in free-flowing cleaning agents and detergents, are constantly increasing, while packaging is remaining the same size, as a result of which the number of measured quantities per packaging unit, and thus the number of opening and closing actions of a measuring-out spout, are significantly increased.

The object of the invention is for a container mentioned in the introduction to be improved to the extent where a greater number of opening and closing actions is made possible. This object is achieved according to the invention.

SUMMARY OF THE INVENTION

The present invention is that of a container, made from a blank that is folded together to form the various walls of a container, with two of the walls having a common edge, and with a weakening line in each of two adjacent walls defining a reclosable pouring element, and with a line of inflection disposed across the pouring element and disposed across the common edge dividing the pouring element into a pouring portion and an operating portion, with the operating portion having a reinforcing element in the region of the edge, and wherein the container is comprised of a fiber material having a dominant fiber direction oriented essentially perpendicularly to the edge.

The reinforcing element in the operating portion effectively reduces wear to the edge to which finger pressure is expediently applied in order to open the pouring element. In addition, the reinforcing element constitutes a target for the user of the container, so that incorrectly positioned finger pressure, which is usually associated with particularly high levels of wear or damage to the container material, is effectively avoided. Even if the finger pressure is not applied at the ideal point, increased wear is largely avoided. A container according to the invention is particularly suitable for storing coarse-grained or fine-grained powders, in particular detergents, cleaning agents or salt for dishwashers. On account of its shaping, the pouring element is highly suitable for measuring out dishwasher salt into a feed means provided on the dishwasher.

Contrary to the view, which prevails among specialists, that it is particularly advantageous for the main folding direction to be oriented parallel to the fiber direction, it is the case, according to a preferred embodiment of the container according to the invention, that the container is formed from a fiber material for example cardboard, a dominant fiber direction being oriented essentially perpendicularly to the main folding direction. The function of the pouring element is thus optimized, in a straightforward and surprising manner, in respect of non-isotropic material properties and in respect of corresponding wear.

It has thus been found, for example, that arranging the fiber perpendicularly to the main folding direction makes it possible to achieve a significantly greater number of opening and closing actions for the spout according to the invention without any fatigue of the fiber material, e.g. in the form of tears forming. It is thus possible, with the same number of predicted opening and closing actions, to use a thinner, and thus more lightweight, fiber material.

It has also been found that the perpendicular fiber arrangement increases the restoring forces of the spout such that the snap action of the spout with over ten opening and closing actions does not noticeably and measurably decrease, as is the case with a main folding direction oriented parallel to the fiber direction.

The action of the spout snapping closed to the full extent is thus ensured by the arrangement of fiber direction to folding direction according to the invention, even after a large number of opening and closing actions, and consequently safeguards the aroma and moisture tightness of the packaging even in the case of intensive use of the latter.

The reinforcing element is particularly preferably formed from the flexible material by means of deformation. The reinforcing element here particularly advantageously comprises an essentially continuous scored line. This makes it possible to form a container according to the invention with particularly low production costs.

In order to ensure that the pouring element of the container according to the invention functions to good effect, the weakening line is curved convexly at least in the region of the operating portion. Such curvature results, in practice, in good distribution of the closing and opening forces of the reclosable pouring element.

In respect of good functioning, it is advantageously provided, in addition, that, in the region of the pouring portion, the weakening line comprises two essentially rectilinear sides which enclose an angle of less than approximately 90 degrees, particularly preferably of less than approximately 70 degrees.

The line of inflection, further advantageously, has an angle, in relation to a planar blank, in the region of the edge. This anole is particularly preferably open in the direction of the pouring portion and is between approximately 110 and approximately 150 degrees. This also ensures that the pouring element functions to particularly good effect.

Furthermore, a preferred embodiment provides for reinforcement of the pouring element at least in part of a peripheral region bounded by the weakening line. The reinforcement is particularly advantageously designed as a flap of the blank, this flap having an aperture essentially in the same shape as the pouring element. Overall, this ensures a better safeguard against wear in the peripheral regions of the pouring element, and it is additionally possible to achieve increased prestressing of the pouring element in the closed or also open state. Slight overlapping of the reinforcement with the peripheral region of the pouring element. in addition, increases the sealing in the closed state, so as to improved aroma and/or moisture safeguards.

When the pouring element is opened, the action of the pouring portion snapping open, further preferably, makes a distinct sound, this providing the user of the container according to the invention with a positive signal when he/she uses the container.

Further advantages and features cm be gathered from the exemplary embodiment described hereinbelow and from the dependent claims.

A preferred exemplary embodiment of a container according to the invention is described hereinbelow and explained in more detail with reference to the attached drawings, in which:

BRIEF DESCRIPTION OF THE DRAWING FIGURES

DETAILED DESCRIPTION OF THE PREFERRED EMBODIMENTS

Figure 1:
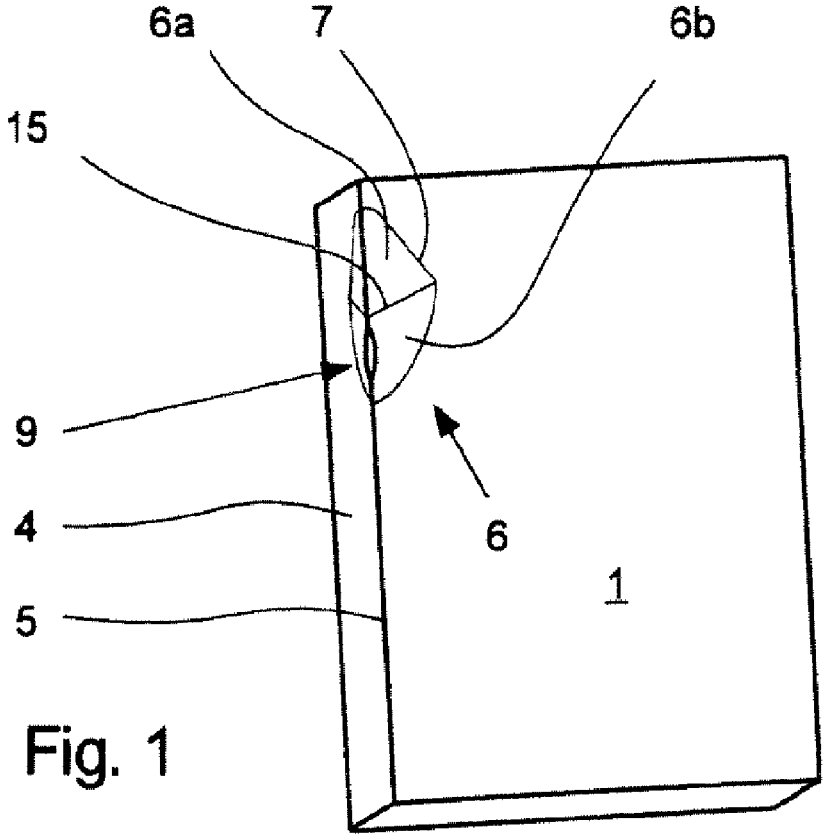
FIG. 1 shows a three-dimensional view of a container according to the invention, with the pouring element in a closed state
Figure 2:
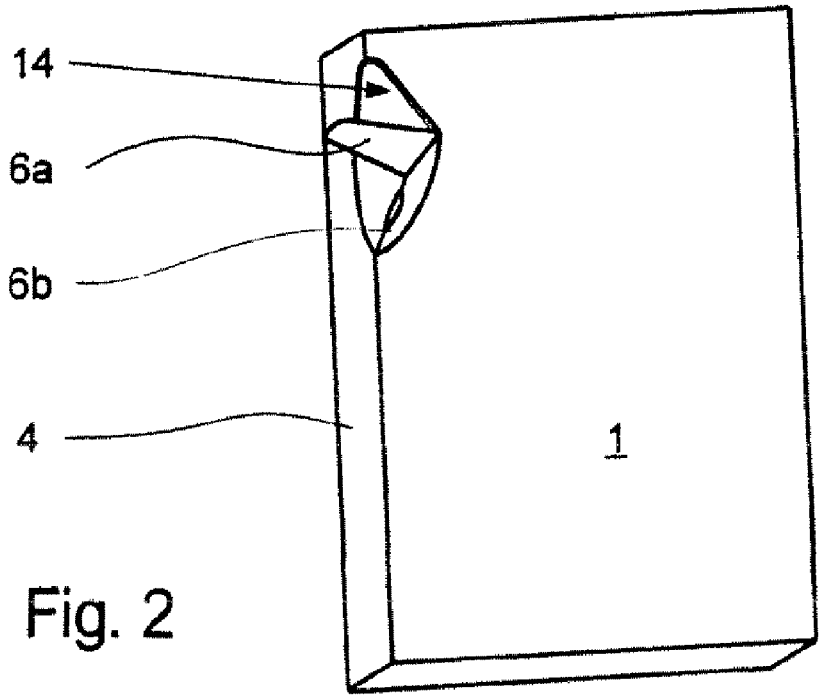
FIG. 2 shows a three-dimensional view of the container from FIG. 1, with the pouring element in an open state.
Figure 3:
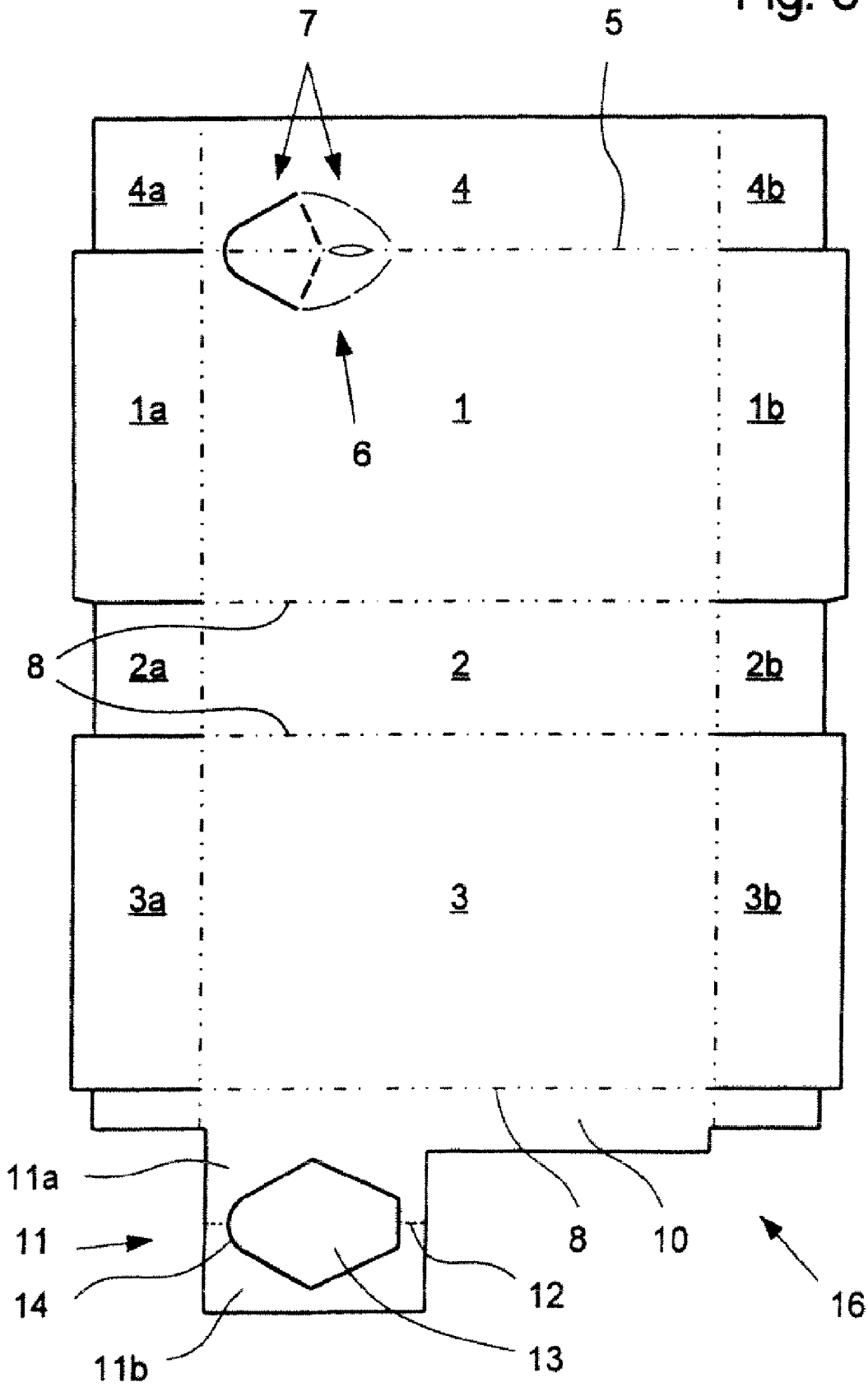
FIG. 3 shows a plan view of a blank from which the container of FIG. 1 can be folded.

The container according to the invention which is shown in FIG. 1 is entirely of cardboard which has dominant fiber direction. The container is a right-angled box with six sides located opposite one another in pairs. The container can be folded from the blank 16 which is shown in FIG. 3, the vertical sides 1, 2, 3, 4 being attached to one another in series and being separated off from one another by scored lines 8. about which the sides 1, 2, 3, 4 can be inflected. A base of the box is formed by base flaps 1*b*, 2*b*, 3*b*, 4*b*, which arc each arranged on the sides via scored lines 8. A cover for the container is formed via corresponding cover flaps 1*a*, 2*a*, 3*a* and 4*a*.

An edge 5 is formed by the scored line which is located between the front side 1 and an end side 4, it being the case that a first wall, which is formed by the front side 1, and a second wall, which is formed by the end side 4, are connected integrally to one another via the edge 5 and are arranged at angle of approximately 90 degrees in relation to one another. A pouring element 6 is located in the region of this edge 5. The pouring element 6 comprises a top, pouring portion 6*a* and a bottom, operating portion 6*b*, the pouring element 6 as a whole being formed symmetrically in relation to the edge 5. The pouring element 6 is surrounded by a weakening line 7 which is continuous overall, part of the weakening line 7 forming the outer periphery of the pouring portion 6*a* and another pan of the weakening line 7 forming the outer periphery of the operating portion 6*b*.

The pouring element 6 is divided into the pouring portion 6*a* and the operating portion 6*b* approximately half way along by a line of inflection 15, which crosses over the edge 5 and, like the weakening line 7, is formed symmetrically in relation to the edge 5. In detail, the weakening line 7 and the line of inflection 15 are formed as follows: the line of inflection 15 is a line which is cut part or all of the way through the container material, the cutting operation leaving behind material crosspieces 15*a* for connecting the pouring portion 6*a* and operating portion 6*b* integrally (see FIG. 4). The weakening line 7 is a line which, apart from short crosspieces, is cut all of the way through the container material in the region of the pouring portion 6*a*, the remaining crosspieces being severed when the pouring portion 6*a* is first opened. In the region of the operating portion 6*b*, the weakening line 7, rather than being cut all of the wav through the flexible container material, is cut into this material only to a certain depth. This allows the operating portion to be inflected to good effect in relation to the walls 1, 4, although it remains integrally connected thereto.

In that region of the edge 5 in which the latter passes through the operating portion 6*b*, a reinforcing element 9 is arranged on the pouring element 6 or the operating portion 6*b*. The reinforcing element 9 is a double scored line in the form of an ellipse which tapers to a point and has its semimajor axis located on the edge 5. The scored line of the edge 5, rather than running continuously, branches into the curves 9*a*, 9*b* of the ellipse in this region (see FIG. 4). As a result, the interior of the surrounding scored line of the reinforcing element 9 defines a surface to which the user of the container can apply finger pressure without the edge 5 being pushed in and adversely affected.

Figure 4:
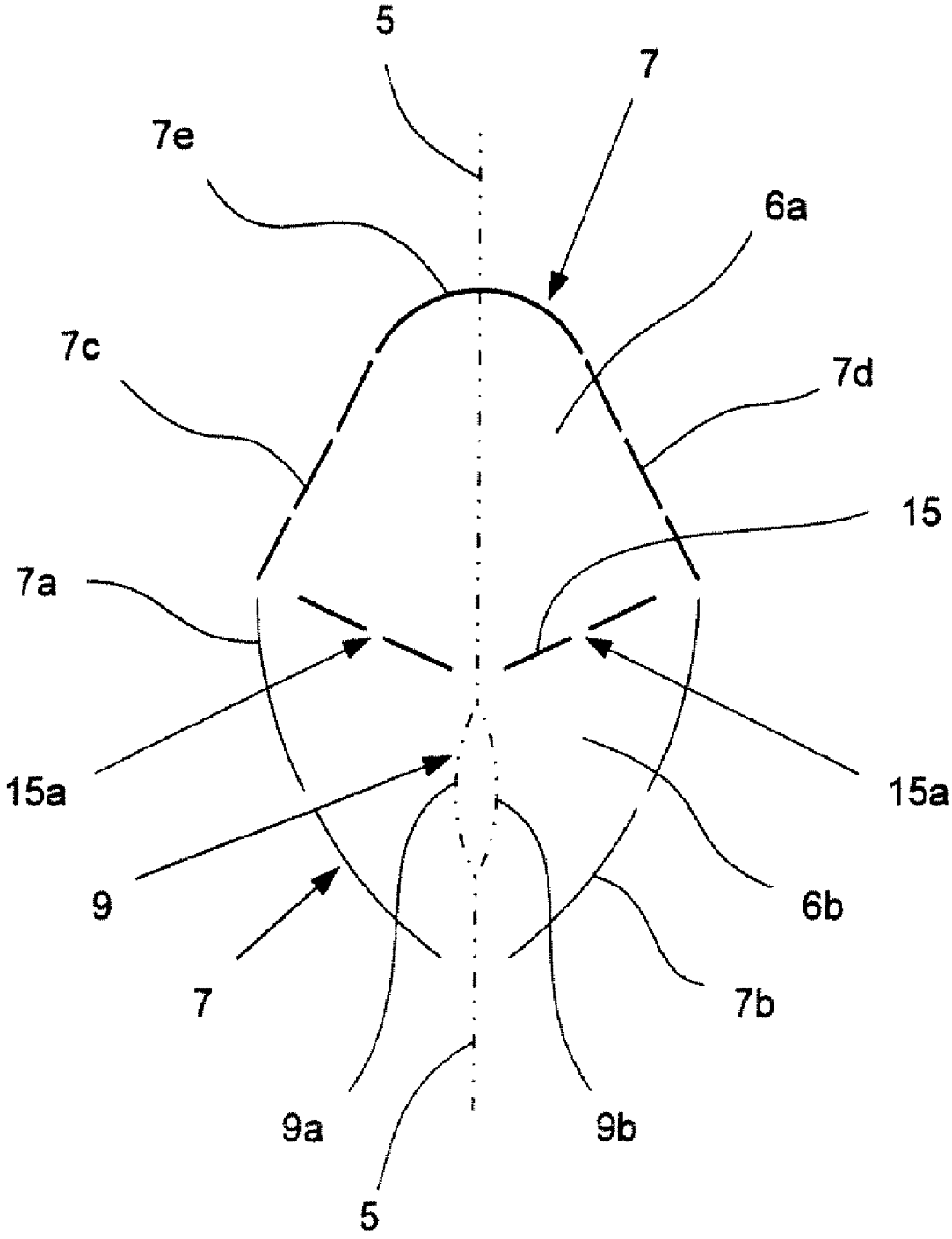
FIG. 4 shows a schematic view, in detail form, of the pouring element of the container according to the invention depicted in FIG. 1.

The more specific formation of the pouring element 6 has further special features for ensuring the function of the latter; in particular, the weakening line 7 is curved convexly in the region of the operating portion 6*b*, the convex curves being designated 7*a*, 7*b* in FIG. 4. In the region of the pouring portion 6*a*, the weakening line 7 has two essentially rectilinear portions 7*c*, 7*d*, which enclose an angle of approximately 57 degrees. These two rectilinear portions 7*e*, 7*d*, however, do not meet at a point; rather, they are connected to one another by means of a portion 7*e* which is in the form of a part of a circle and, at the same time, forms a rounded tip of the pouring portion 6*a*. The line of inflection 15 has an angle, in relation to the planar blank according to FIG. 3, which is bisected by the edge 5 and is approximately 130 degrees overall, For further specific dimensional ratios and shaping information, reference is made to the fact that the blank according to FIG. 3 and the detail according to FIG. 4 constitute a true-to-scale representation of a container according to the invention.

As FIG. 3 shows, the blank of the container according to the invention has a flap 11 which is formed together with an adhesive-bonding flap 10 and comprises a first flap half 11*a* and a second flap half 11*b*, which is separated from the first by a scored line 12. Extending symmetrically in relation to the scored line 12, and thus over both flap halves 11*a*, 11*b*, an aperture 13, which essentially corresponds to the pouring element 6 in terms of shape and size, is punched out of the flap 11. In the folded state of the container, this aperture 13 has its peripheral region 14 located within the container, behind the pouring element 6, so that the pouring element is reinforced in its peripheral region defined by the weakening line 7. The pouring element 6 can thus overlap with the peripheral region 14 or even butt against the same, this resulting in improved sealing and also allowing increased prestressing of the pouring element 6 in the closing direction.

The invention functions, then, as follows:

Starting from the closed state of the container according to FIG. 1, the user of the container uses a finger, e.g. thumb or index finger, to apply pressure to the reinforcing element 9. The operating portion 6*b* is thus pushed in the direction of the container interior, and the curved portions 7*a*, 7*b* of the weakening line 7 are pushed outward, the container walls 1, 4 and the reinforcement 11, 13 providing resilient resistance counter to this. The pouring portion 6*a* executes a movement in the direction counter to the operating portion 6*b*, the rounded tip 7*e* of the pouring portion 6*a* moving outward and releasing a container opening. Once a dead-center position has been passed, the spring forces of the walls 1, 4 no longer act counter to the pressure applied by the user's finger, but rather assist the same, so that the pouring portion 6*a* suddenly swings outward and the operating element 6*b* suddenly yields inward. On account of the spring prestressing provided beforehand, this results in the deformed walls 1, 4 making a sound, which can be described onomatopocically as "plop". With the above described dimensioning and angular measurements, the angling of the surfaces of the pouring element 6*a* in the open state are similar to that in the closed state, so that the pouring portion forms a spout for measuring out the pack contents in a specific manner. The operating portion 6*b*, in respect of the angling of its surfaces, has been moved into an inverted position. The container is closed by virtue of the pouring portion 6*a* being swung upward, as a result of which the operating portion 6*b* swings back again into its initial position. There is also a dead-center position here and, once it has passed this position, the pouring portion 6 springs into its closed position, making a distinct sound in the process.

What is claimed is:

1. A container, in particular for free-flowing substances, comprising:

a plurality of walls folded together from a blank (16) of sheet-like, flexible material, at least part of the container comprising, a first wall (1) and a second, adjacent wall (4), the walls (1, 4) being angled in relation to one another and being connected integrally to one another in the region of a common edge (5), a weakening line (7) in each of the walls (1, 4) said weakening line surrounding a region of a reclosable pouring element (6), which is formed essentially from the material of the walls (1, 4), with a line of inflection (15) cut at least part way through the blank (16) leaving material crosspieces (15*a*) and disposed across the pouring element (6), and disposed across the common edge (5) dividing the pouring element (6) into a pouring portion (6*a*) and an operating portion (6*b*), said pouring portion (6*a*) and said operating portion (6*b*) being integrally connected by said crosspieces (15*a*), a reinforcing element (9) in the operating portion (6*b*) in the region of the edge (5) and comprising a double scored line in the form of an ellipse, wherein the container is comprised of a fiber material, having a dominant fiber direction oriented essentially perpendicularly to the edge (5) wherein the weakening line (7) comprises convex curve lines (7*a*, 7*b*) and is curved convexly in the region of the operating portion (6*b*), wherein in the region of the pouring portion (6*a*), the weakening line (7) has two essentially rectilinear portions (7*c*, 7*d*), which enclose an acute angle, and wherein the two rectilinear portions (7*c*, 7*d*), are connected to one another by means of a line portion (7*e*) which is in the form of a part of a circle, forming a rounded tip of the pouring portion (6*a*).

2. The container as claimed in claim 1, characterized in that the reinforcing element (9) is formed from the flexible material by means of deformation.

3. The container as claimed in claim 1 characterized in that the reinforcing element (9) comprises an essentially continuous scored line (9*a*, 9*b*).

4. The container as claimed in claim 1, wherein the two essentially rectilinear portions (7*c*, 7*d*) enclose an angle of less than approximately 90 degrees.

5. The container as claimed in claim 4, characterized in that the two essentially rectilinear portions (7*c*, 7*d*) enclose an angle of less than approximately 70 degrees.

6. The container as claimed in claim 1, characterized in that the line of inflection (15) has an angle in the region of the edge.

7. The container as claimed in claim 6, characterized in that the angle of the line of inflection (15) is open in the direction of the pouring portion (6*a*) and is between approximately 110 and approximately 150 degrees.

8. The container as claimed in claim 1, characterized in that the pouring element (6*a*) has a reinforcement (11) at least in part of a peripheral region bounded by the weakening line (7).

9. The container as claimed in claim 8, characterized in that the reinforcement (11) is designed as a flap of the blank (16), this flap having an aperture (13) essentially in the same shape as the pouring element (6).

10. The container as claimed in claim 1, characterized in that, when the pouring element (6) is opened, the action of the pouring portion (6*a*) snapping open makes a distinct sound.

11. The container of claim 1, wherein the fiber material is cardboard.

12. The container of claim 1, wherein the ellipse tapers to a point and has a semi-major axis located on the edge.

13. The container of claim 1, wherein the ellipse is comprised of curves and the double scored line branches into the curves of the ellipse.

14. A method of using the container of claim 1, including the step of storing a powder material for dishwashing therein which powder material is selected from any of:

(a) a detergent;

(b) a cleaning agent; and (c) a salt.

15. the method of claim 14 wherein the powder material is selected from any of:

(a) a course-grained powder; and (b) a fine-grained powder.

* * * * *